US005954005A

United States Patent [19]

Sekine et al.

[11] Patent Number: 5,954,005

[45] Date of Patent: Sep. 21, 1999

[54] OPERATION STATUS SETTING DEVICE FOR PATTERN SEWING

[75] Inventors: Kiyokazu Sekine, Kuwana-gun; Fumiaki Asano, Nagoya, both of Japan

[73] Assignee: Brother kogyo Kabushiki Kaisha, Nagoya, Japan

[21] Appl. No.: 09/045,684

[22] Filed: Mar. 23, 1998

[51] Int. Cl.[6] ..... D05B 19/00

[52] U.S. Cl. ..... 112/470.04; 112/155; 112/445; 112/475.19

[58] Field of Search ..... 112/470.04, 470.01, 112/470.06, 102.5, 155, 275, 277, 445, 457, 475.19, 475.01

[56] References Cited

U.S. PATENT DOCUMENTS

| | | | |
|---|---|---|---|
| 4,936,232 | 6/1990 | Monma | 112/155 X |
| 5,050,513 | 9/1991 | Frankel | 112/275 X |
| 5,218,916 | 6/1993 | Kurono et al. | 112/445 X |

*Primary Examiner*—Peter Nerbun
*Attorney, Agent, or Firm*—Oliff & Berridge, PLC

[57] ABSTRACT

A pattern sewing system having at least one pattern sewing machine which has a plurality of sewing heads, an operation status setting device which is electrically connected to the at least one pattern sewing machine, the operation status setting device setting operation status of each of the plurality of sewing heads such that each of the plurality of sewing heads is operative or inoperative, and a controlling device which makes the operation status set by the operation status setting device effective.

14 Claims, 6 Drawing Sheets

FIG. 6A

| | 1 | 2 | 3 | 4 | 5 | 6 |
|---|---|---|---|---|---|---|
| MEMORY M | 1 | 1 | 1 | 1 | 1 | 0 |

FIG. 6B

| | 1 | 2 | 3 | 4 | 5 | 6 |
|---|---|---|---|---|---|---|
| MEMORY P | 1 | 1 | 1 | 0 | 1 | 0 |

FIG. 7A

| | 1 | 2 | 3 | 4 | 5 | 6 |
|---|---|---|---|---|---|---|
| MEMORY K | 1 | 1 | 1 | 1 | 1 | 0 |

FIG. 7B

| | 1 | 2 | 3 | 4 | 5 | 6 |
|---|---|---|---|---|---|---|
| MEMORY L | 1 | 1 | 1 | 1 | 1 | 0 |

FIG. 7C

| | 1 | 2 | 3 | 4 | 5 | 6 |
|---|---|---|---|---|---|---|
| MEMORY K | 1 | 1 | 1 | 1 | 1 | 0 |

FIG. 7D

| | 1 | 2 | 3 | 4 | 5 | 6 |
|---|---|---|---|---|---|---|
| MEMORY L | 1 | 1 | 1 | 0 | 1 | 0 |

FIG. 7E

| | 1 | 2 | 3 | 4 | 5 | 6 |
|---|---|---|---|---|---|---|
| MEMORY K' | 1 | 1 | 1 | 1 | 1 | 0 |

FIG. 7F

| | 1 | 2 | 3 | 4 | 5 | 6 |
|---|---|---|---|---|---|---|
| MEMORY K | 1 | 0 | 1 | 1 | 1 | 1 |

FIG. 7G

| | 1 | 2 | 3 | 4 | 5 | 6 |
|---|---|---|---|---|---|---|
| MEMORY L | 1 | 0 | 1 | 0 | 1 | 1 |

OPERATION STATUS SETTING DEVICE FOR PATTERN SEWING

BACKGROUND OF THE INVENTION

The present invention relates to an operation status setting device for setting operation status of sewing heads in a pattern sewing system.

Conventionally, a pattern sewing system provided with one or more pattern sewing machines such as an embroidery sewing machine, or a sewing machine for sewing a predetermined pattern, e.g., a pocket setter, have been known. In such a pattern sewing system, each swing machine is provided with a plurality of sewing heads. The number of the sewing heads to operate simultaneously is determined depending on the amount of products to be made by the sewing system.

Generally, a stop switch is provided on each sewing head, and an operator sets ON/OFF status of the stop switch of each sewing head to an ON status (inoperative) or OFF status (operative).

A drawback in such a system is that the operator must operate the stop switch manually. If the sewing head is relatively far from the operator, and further, if there are a considerable number of sewing heads, whose stop switches are to be operated, operation of all the stop switches is troublesome, and may lower the efficiency of the sewing operation.

SUMMARY OF THE INVENTION

It is therefore an object of the invention to provide an improved operation status setting device with which the operation status of a plurality of sewing heads can be set efficiently.

For the above object, according to the present invention, there is provided a pattern sewing system, which comprises at least one pattern sewing machine which has a plurality of sewing machine, the operation status setting device which is electrically connected to the at least one pattern sewing machine, the operation status setting device setting operation status of each of the plurality of sewing heads such that each of the plurality of sewing heads is operative or inoperative; and a controlling device which makes the operation status set by the operation status setting device effective.

Thus, with use of a single operation status setting device, operative/inoperative status of all of the sewing heads can be set.

In particular, the operation status setting device may be an independent device provided separately from the at least one pattern sewing machine. Alternatively, the operation status setting device may be associated with the at least one pattern sewing machine.

The pattern sewing system may have a plurality of pattern sewing machines each having a plurality of sewing heads, and the controlling device may be provided in each of the plurality of sewing machines.

Optionally, the plurality of sewing heads may have a plurality of manually operative switches respectively corresponding to the plurality of sewing heads, each of the plurality of manually operative switches setting operation status of the plurality of sewing heads such that each of the plurality of sewing heads is operative or inoperative, the operation status setting device utilizing the operation status set by the plurality of manually operative switches as initial status.

In this case, the operation status setting device may set the operation status of the plurality of sewing heads by modifying the operation status set by the plurality of manually operative switches.

Further, optionally, the operation status setting device comprises a display device which displays a dialog box showing the operation status of each of the plurality of manually operative switches; and a designating device which is manually operated to designate the operation status of each of the plurality of manually operative switches, each of the operation status of each of the plurality of manually operative switches being changed when designated by the designating device.

In particular, the designating device comprises a mouse, and preferably, by clicking each of the operation status shown in the dialog box, it may be changed.

It is preferable that the designating device may include a preventing device which prevents the operation status of each of the plurality of manually operative switches displayed on the display device from being designated to change the operation status of the plurality of sewing heads from inoperative to operative.

Accordingly, as far as the manually operative switch is set to an inoperative state, the corresponding sewing head never operates, which improves security of the pattern sewing system.

Still optionally, when the operation setting device may set the operation status of the plurality of sewing heads after the plurality of manually operative switches are operated, the operation status set by the operation setting device is made effective by the controlling device.

Furthermore, when at least one of the plurality of manually operative switches is operated after the operation setting device sets the operation status, operation status of at least one of the plurality of sewing heads corresponding to the operated at least one of the plurality of manually operative switches is made effective by the controlling device.

According to another aspect of the invention, there is provided an operation status setting device for setting an operation status of each of a plurality of sewing heads of at least one pattern sewing machine, the operation status setting device being electrically connected to the at least one pattern sewing machine, the operation status setting device comprising a data receiving device which receives data representing a currently set operation status of each of the plurality of sewing heads from the at least one sewing machine; a displaying device which displays the currently set operation status of each of the plurality of sewing heads based on data received by the data receiving device; a manually operative member which is manually operated to change the currently set operation status of each of the plurality of sewing heads; and a data transmitting device which transmits, to the at least one swing machine, data representing a currently set operation status in which operation of the manually operative member is reflected.

According to a further aspect of the invention, there is provided a method of changing the operation status of a plurality of sewing heads in a sewing machine, each of the plurality of sewing heads being provided with a switch for setting the operation status thereof to operative or inoperative, the method including the steps of receiving status data representing operation status of the plurality of sewing heads from a host controller; storing the status data received from the host controller in a memory; detecting a setting status of the switch for each of the plurality of sewing heads; updating the status data stored in the memory with reference to the setting status of the switch; and driving the plurality of sewing heads in accordance with the status data stored in the memory and updated in the updating step.

According to a further aspect of the invention, there is provided a memory medium for storing a program executed by a controlling device which controls operation of each of a plurality of sewing heads of at least one pattern sewing machine, the controlling device being electrically connected to the at least one pattern sewing machine, the program comprising steps of receiving data representing a currently set operation status of each of the plurality of sewing heads from the at least one sewing machine; displaying the currently set operation status of each of the plurality of sewing heads based on data received at the step of receiving; changing the currently set operation status of each of the plurality of sewing heads; and transmitting, to the at least one sewing machine, data representing a currently set operation status in which changes made at the step of changing are reflected.

Thus, any controlling device which is capable of controlling each of a plurality of sewing heads of at least one pattern sewing machine, and executing the program stored in the memory medium functions as the operation status setting device.

BRIEF DESCRIPTION OF THE DRAWINGS

FIGS. 6A and 6B show examples of data stored in memories M and P;

FIGS. 7A through 7G show examples of data stored in memories K, K' and L.

DETAILED DESCRIPTION OF THE PREFERRED EMBODIMENTS

Figure 1:
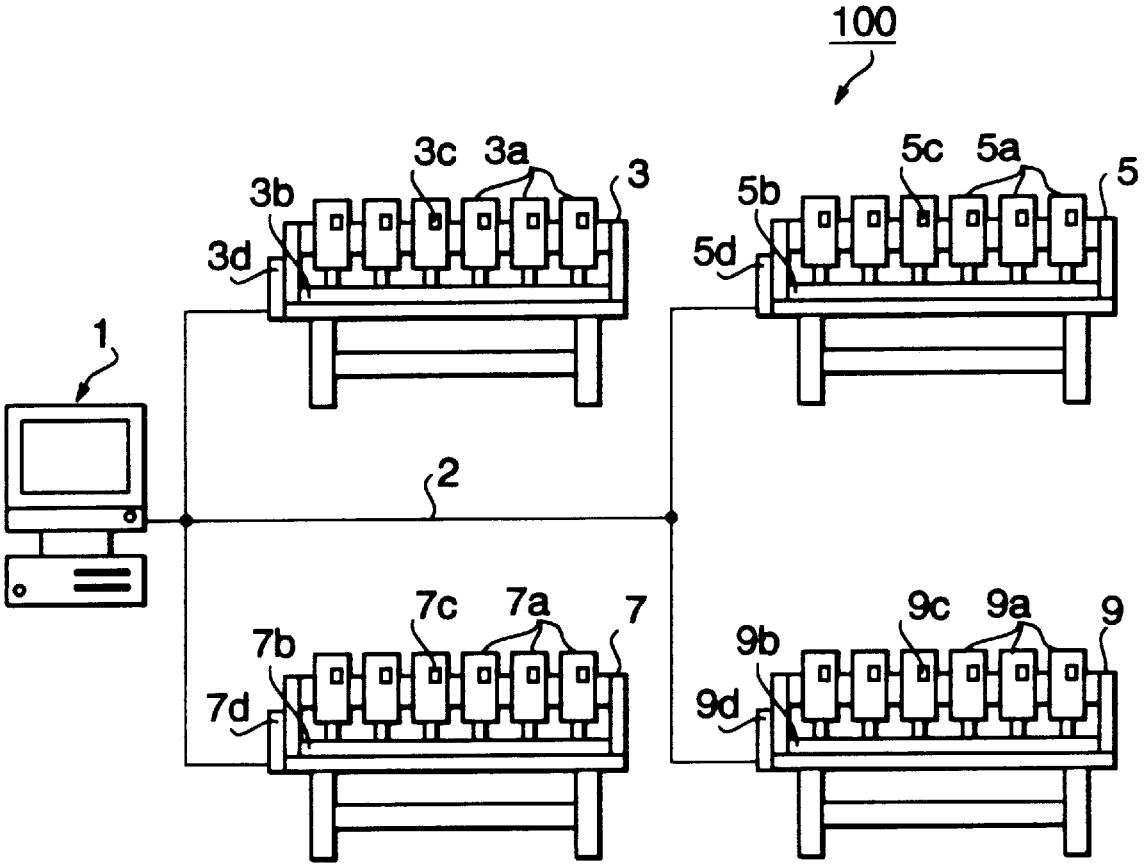
FIG. 1 shows a schematic construction of a pattern sewing system employing an operation status setting device according to an embodiment of the invention.

FIG. 1 shows a schematic construction of a pattern sewing system 100 employing an operation status setting device according to an embodiment of the present invention.

The pattern sewing system 100 includes a personal computer 1, and a plurality of multi-head pattern sewing machines 3, 5, 7 and 9. The multi-head pattern sewing machines 3, 5, 7 and 9 are connected to the personal computer 1 through a cable 2. It should be noted that although four pattern sewing machines are provided in the pattern sewing system 100 in the present embodiment, the number of the pattern sewing machines is not limited to this number.

The multi-head pattern sewing machines 3, 5, 7 and 9 respectively have a plurality of sewing heads 3*a*, 5*a*, 7*a* and 9*a*, work cloth holding frames 3*b*, 5*b*, 7*b* and 9*b*, and controlling devices 3*d*, 5*d*, 7*d* and 9*d*. The personal computer 1 is connected with the controlling devices 3*d*, 5*d*, 7*d*, and 9*d* through the cable 2. On the sewing heads 3*a*, 5*a*, 7*a*, and 9*a*, stop switches 3*c*, 5*c*, 7*c* and 9*c* manually operative to set each of the operation status of the sewing heads 3*a*, 5*a*, 7*a* and 9*a* to be operative or inoperative are provided, respectively.

Figure 2:
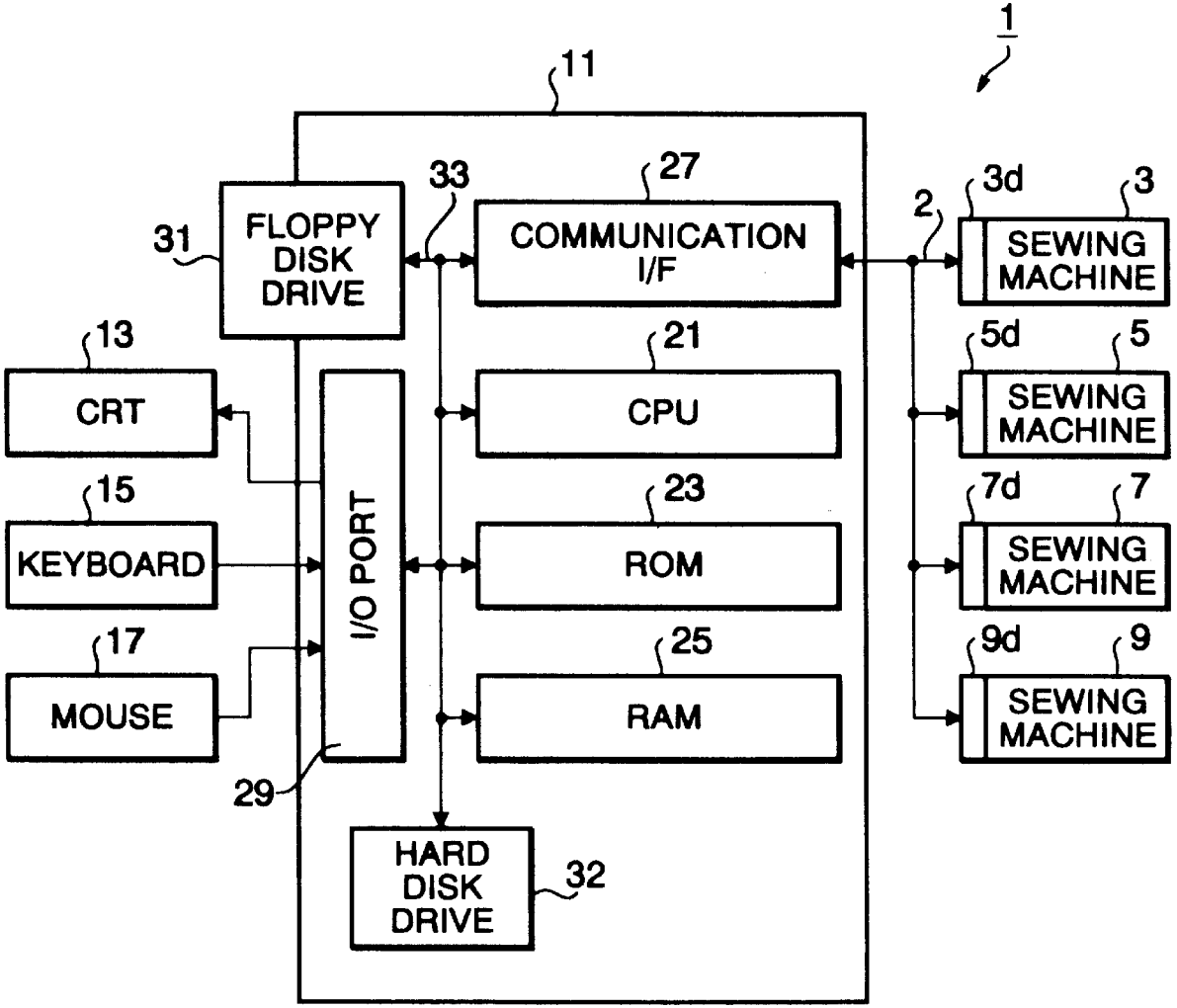
FIG. 2 is a block diagram illustrating a control system of a personal computer employed in the pattern sewing system shown in FIG. 1.

FIG. 2 is a block diagram illustrating a control system of the personal computer 1 shown in FIG. 1. The personal computer 1 has a main body 11, a CRT (Cathode Ray Tube) display 13, a keyboard 15 and a mouse 17.

The main body 11 of the personal computer 1 includes a CPU (Central Processing Unit) 21, a ROM (Read Only Memory) 23, a RAM (Random Access Memory) 25, a communication interface (I/F) 27 for communicating with the multi-head pattern sewing machines 3, 5, 7 and 9 through the cable 2, an input/output (I/O) port 29 through which data is transmitted from the CPU 21 to the CRT 13, and from the keyboard 15 and the mouse 17 to the CPU 21. Further, the main body 11 includes a floppy disk drive 31 for reading/writing data to/from a floppy disk (not shown), and a hard disk drive 32 for reading/writing data to/from a hard disk (not shown). Data can be exchanged among the CPU 21, the ROM 23, the RAM 25, the communication I/F 27, the I/O port 29, the floppy disk drive 31, and the hard disk drive 32 through a bus 33.

When a floppy disk, in which a plurality of kinds of pattern data is stored, is inserted in the floppy disk drive 31, and a predetermined command is input through keyboard 15, the CPU 21 executes a program stored in the ROM 23, selects one piece of the pattern data and transmits the selected pattern data to the controlling device 3*d*, 5*d*, 7*d* and 9*d* so that a sewing procedure is executed. Further, the CPU 21 transmits a signal regarding the operation status (i.e., operative or inoperative) of each of the sewing heads 3*a*, 5*a*, 7*a* and 9*a* to the appropriate controlling device 3*d*, 5*d*, 7*d* and 9*d*.

The controlling devices 3*d*, 5*d*, 7*d* and 9*d* transmit operation condition data indicative of operation status of the controlling devices 3*d*, 5*d*, 7*d* and 9*d*, an ON/OFF status of each of the stop switches 3*c*, 5*c*, 7*c* and 9*c*, and the like to the personal computer 1 together with identification numbers of the pattern sewing machines 3, 5, 7 and 9. It should be noted that the ON status of the stop switch corresponds to an inoperative status of a sewing head, and OFF status of the stop switch corresponds to an operative status of the sewing head.

Hereinafter, an operation status setting procedure executed by the personal computer 1 will be described in detail with reference to FIG. 3. In the pattern sewing system 100, when the operation status setting procedure is executed, the ON/OFF status of each sewing head can be set with use of the personal computer 1. The operation status setting procedure is stored as a program to be executed by the CPU 21 in the ROM 23.

When the operation status setting procedure is executed, it is determined whether an operator inputs a command, through the keyboard 15 and/or the mouse 17, to initiate setting the operation status of the sewing head (S110). If such a command has not been input (S11:NO), it is further determined whether a command for initiating another operation has been input (S120). IF such a command has not been input (S120:NO), control returns to S110. If a commands for executing an operation other than the operation for setting the operation status of the sewing head has been input (S120:YES), the corresponding operation is executed at S130, and then control returns to S110.

If the operator has input the command for initiating the setting of the operation status of the swing heads (S110:YES), the personal computer 1 sends a command requesting each of the sewing machines 3 through 9 to sent data indicating the current operation status of the sewing heads through the cable 2 (S140). In response to the above command, ON/OFF status of each of the sewing heads 3*a* through 9*a* is transmitted by the sewing machines 3 through 9 via the cable 2. The transmitted data (i.e., ON/OFF status data) is stored in the memory M of the RAM 25 (S150).

The data stored in the memory M contains 6-bit data for each of the sewing heads 3 through 9, and each bit of the 6-bit data indicates the ON/OFF status of each of the stop switches 3c through 9c of the heads 3a through 9a. As described above, initially, the ON status indicates that the sewing head is currently inoperative, and the OFF status indicates the sewing head is currently operative.

As an example, in FIG. 6A, a status of the stop switches 7c of the sewing heads 7a of the pattern sewing machine 7 is indicated. In this example, the first through fifth bits are OFF (i.e., set to "1"), and the sixth bit is ON (i.e., set to "0"). Accordingly, the first to fifth stop switches 7c of the sewing heads 7a are currently set to "OFF", and the sixth stop switch 7c of the last sewing head 7a is currently set to "ON".

Figure 5A:
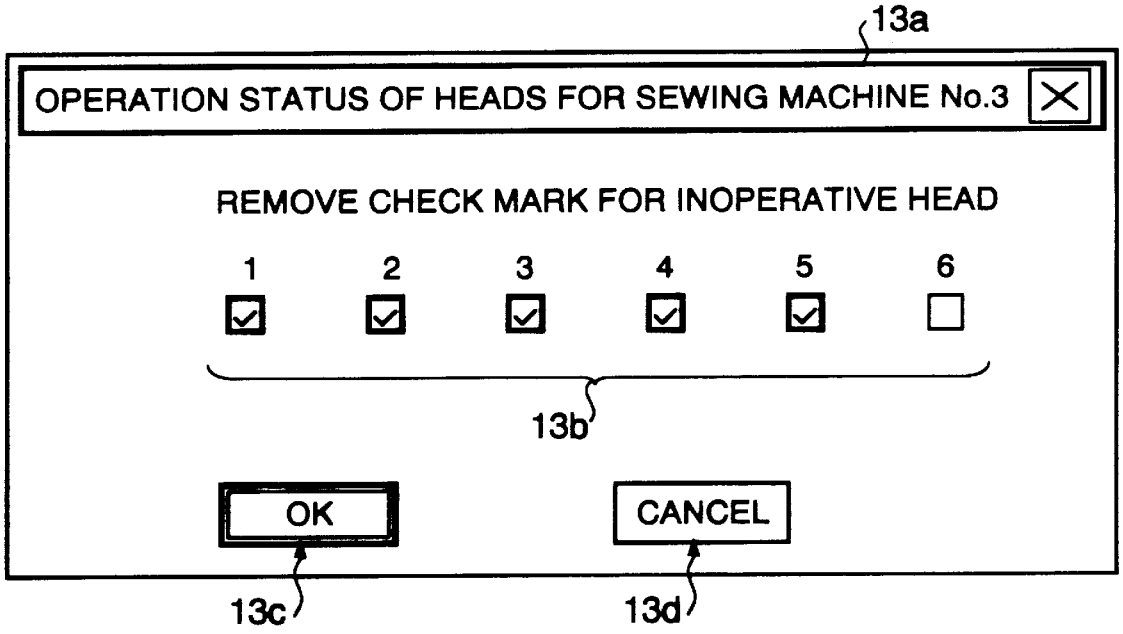
FIGS. 5A and 5B show examples of dialog boxes displayed on a CRT (Cathode Ray Tube) display.

After the data indicative of the current status of the stop switches 7c is stored in the memory M, a setting dialog box 13a as shown in FIG. 5A is displayed on the CRT display 13 (S160). The setting dialog box 13a initially reflects the data stored in the memory M.

In the example shown in FIG. 5A, the dialog box 13a is for setting the operation status of the sewing heads 7a of the pattern sewing machine 7. As described above and shown in FIG. 6A, in this example, the first to fifth stop switches 7c are initially set to OFF (i.e., "1"), and the sixth switch 7c is ON (i.e., set to "0"). Accordingly, the first to fifth check boxes 13b are checked, and the sixth box is not checked.

The settings for the sewing heads 3a, 5a, and 9a of the other sewing machines 3, 5 and 9 may be displayed at different areas of the CRT display 13. All the dialog boxes 13a would be similar to that shown in FIG. 5A, and description for the dialog boxes for the other sewing machines will be omitted.

At S170, a user setting of the operation status of each of the sewing heads 7c is made. If the operator considers the setting shown in the dialog box 13a (as shown in FIG. 5A) is acceptable as is, by clicking an OK button 13c or a CANCEL button 13d by the mouse 17, the setting procedure is terminated. It should be noted that, in this specification, an operation of locating a mouse pointer onto a certain button displayed on the CRT display 13 and clicking the mouse button of the mouse 17 is referred to as an operation of clicking the button.

Figure 5B:
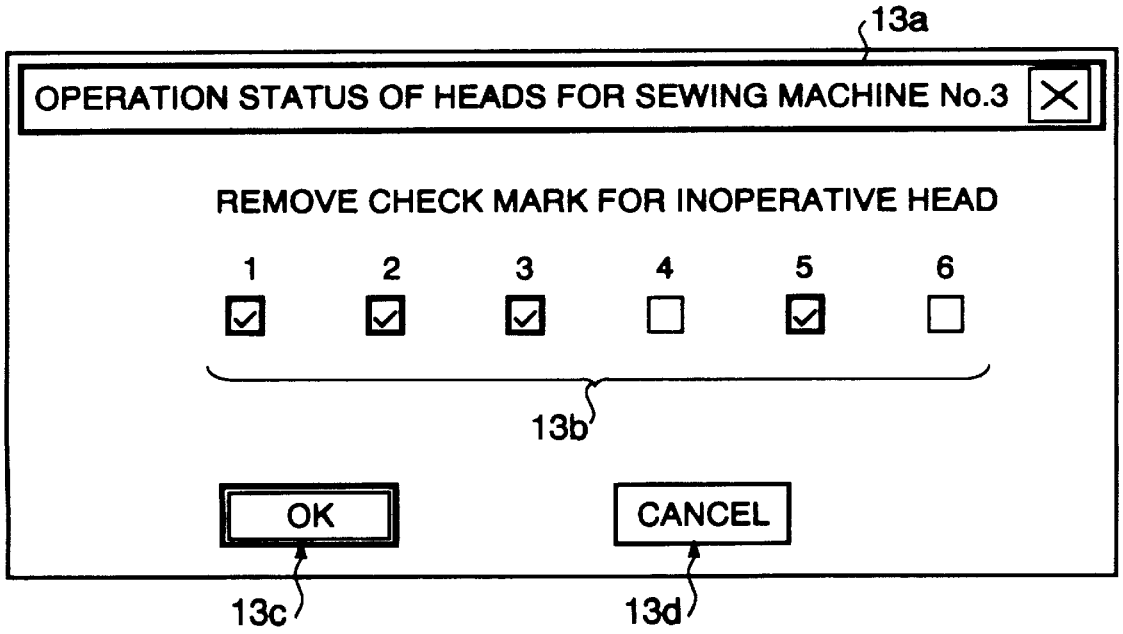

If, for example, the operator intends to set the fourth head 7a of the sewing machine 7 to be inoperative, by clicking a fourth check box 13b from the left (i.e., the box 13b below the numeral "4"), the check mark in the box 13b for the fourth sewing head 7a is removed as shown in FIG. 5B. For the other check boxes 13b, the similar operation can be performed (i.e., the check marks can be removed) to change the operation status of the sewing heads from operative to inoperative. It should be noted that the sixth check box 13b is not checked since the stop switch 7c is set to "ON" on the sewing head, and even if the sixth check box 13b is clicked, the setting of the stop switch 7c cannot be changed to "OFF" from the personal computer, and therefore the check mark cannot be inserted. In other words, the operator cannot change the setting of the stop switch 7c from "ON" to "OFF" from the personal computer when the stop switch has been set to "ON" manually on the sewing head 7a. If the change of the setting of the stop switch 7c from "ON" to "OFF" by the personal computer is allowed, it is dangerous since the sewing head 7a may operated even if the stop switch 7c is set to "ON". Therefore, the personal computer prevents the change of the setting of the stop switch 7c from "ON" to "OFF" with use of the dialog box 13a.

After the user setting operation at S170 is finished, i.e., the operator has removed the check marks and clicked the OK button 13c, the status data as changed is stored in a 6-bit data memory P which is provided in the RAM 25 (S180). An exemplary status of the memory P is shown in FIG. 6B. In FIG. 6B, a data bit having "1" represents an operative sewing head (i.e., a sewing head whose stop switch is set to "OFF"), and a data bit having a value "0" represents an inoperative sewing head (i.e., a sewing head whose stop switch is set to "ON").

Similar to the above, for each of the other sewing machines 3, 5 and 9, the operation status settings are performed and stored in the 6-bit data memory P.

Then, at S190, the setting data stored in the 6-bit data memory P is transmitted to the sewing machines 3, 5, 7 and 9. Then, control returns to S110, and the above-described procedure is repeatedly executed.

Figure 4:
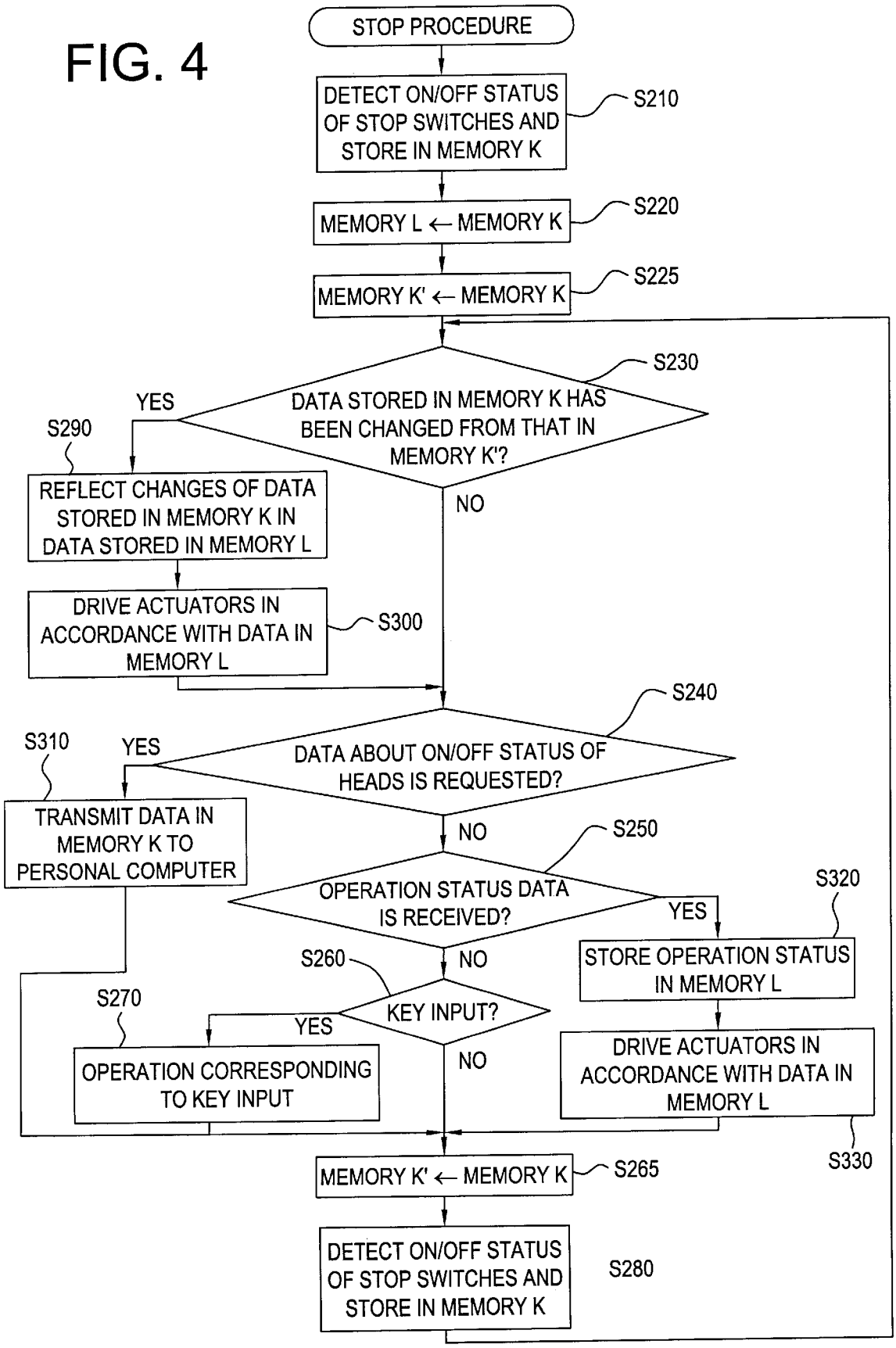
FIG. 4 shows a flowchart illustrating a stop procedure executed by a controlling device of each sewing machine.

The above-described operation status setting procedure is a procedure executed by the personal computer 1. Next, a stop procedure executed by each of the controlling devices 3d, 5d, 7d and 9d of the multi-pattern sewing machines 3, 5, 7 and 9 will be described with reference to a flowchart shown in FIG. 4.

In the following description, the stop procedure executed by the controlling device 7d is explained as an example. The controlling devices 3d, 5d, and 9d execute the stop procedure in the same way, and the description thereof will be omitted because of the similarity.

Firstly, the current ON/OFF status of the stop switches 7c of the sewing heads 7a is detected, and stored in a memory K in a RAM of the controlling device 7d (S210). The ON/OFF status of the stop switches 3c, 5c and 9c of the sewing heads 3a, 5a and 9a is also detected and stored. FIG. 7A shows an example of the data thus stored in the memory K. In this example, only the sixth stop switch 7c is set to ON (i.e., inoperative).

At S220, the data stored in the memory K is copied into a 6-bit data memory L of the RAM in the controlling device 7d. At S225, the data stored in the memory K is also copied into a 6-bit data memory K' of the RAM in the controlling device 7d.

At S230, it is determined whether the data in the memory K has been changed, i.e., at least one of the stop switches 7c is operated. At the first time when S230 is executed in the stop procedure, it is determined that no change has been made (S230:NO) since the data stored in the memory K represents the ON/OFF status of the switches 7c when the stop procedure is executed, and then, at S240, it is determined whether a command requesting the data indicating the operation status of the sewing heads has been received from the personal computer 1.

If the controlling device 7d has received no command requesting the data indicting the operation status of the sewing heads (S240:NO), it is determined whether data representing the operation status of the sewing heads has been transmitted from the personal computer 1 (S250).

If the data representing the operation status of the sewing heads has not been received (S250:NO), then it is determined whether a keyboard of the controlling device 7d has been operated (S260). If the keyboard of the controlling device 7d has been operated (S260:YES), the controlling device 7d controls the pattern sewing machine 7 in accordance with the operation of the keyboard of he controlling device 7d (S270).

If the keyboard of the controlling device 7d has not operated (S260:NO), the data currently stored in the memory K is copied into the memory K' (S265). Then the ON/OFF status of the stop switches 7*c* of the six sewing heads 7*a* is detected, and the data stored in the memory K is updated in accordance with the detected ON/OFF status (S280). Then, control returns to S230.

If at least one of the stop switches 7*c* has been manually operated, the ON/OFF status of the switches 7*c* are different from that stored in the memory K'. In this case, it is determined that the data stored in the memory K has been changed with respect to the data stored in the memory K' (S230:YES). Then, at S290, the data bit(s) in the memory L is set to coincide with the data bit(s) in the memory K having been changed (S290).

At S300, in accordance with the data stored in the memory L, an actuator (e.g., a needle bar jumping solenoid) provided for each sewing head is driven. The actuator is provided for each sewing head 7*a* to operate a clutch mechanism for being connected to transmit a rotational force of a main shaft (not shown) of the sewing machine 7 to a sewing mechanism of each sewing head 7*a*.

Specifically, a clutch member corresponding to a data bit in the memory L whose value is "1" is connected so that the sewing mechanism of the corresponding head 7*a* is driven by the rotational force of the main shaft. A clutch member corresponding to a data bit whose value is "0" is disconnected, and the sewing mechanism of the head corresponding thereto is inoperative (i.e., not driven). As above, the ON/OFF status of the stop switches 7*c* of the sewing heads 7*a* are related to the operation of each head 7*a*.

Figure 3:
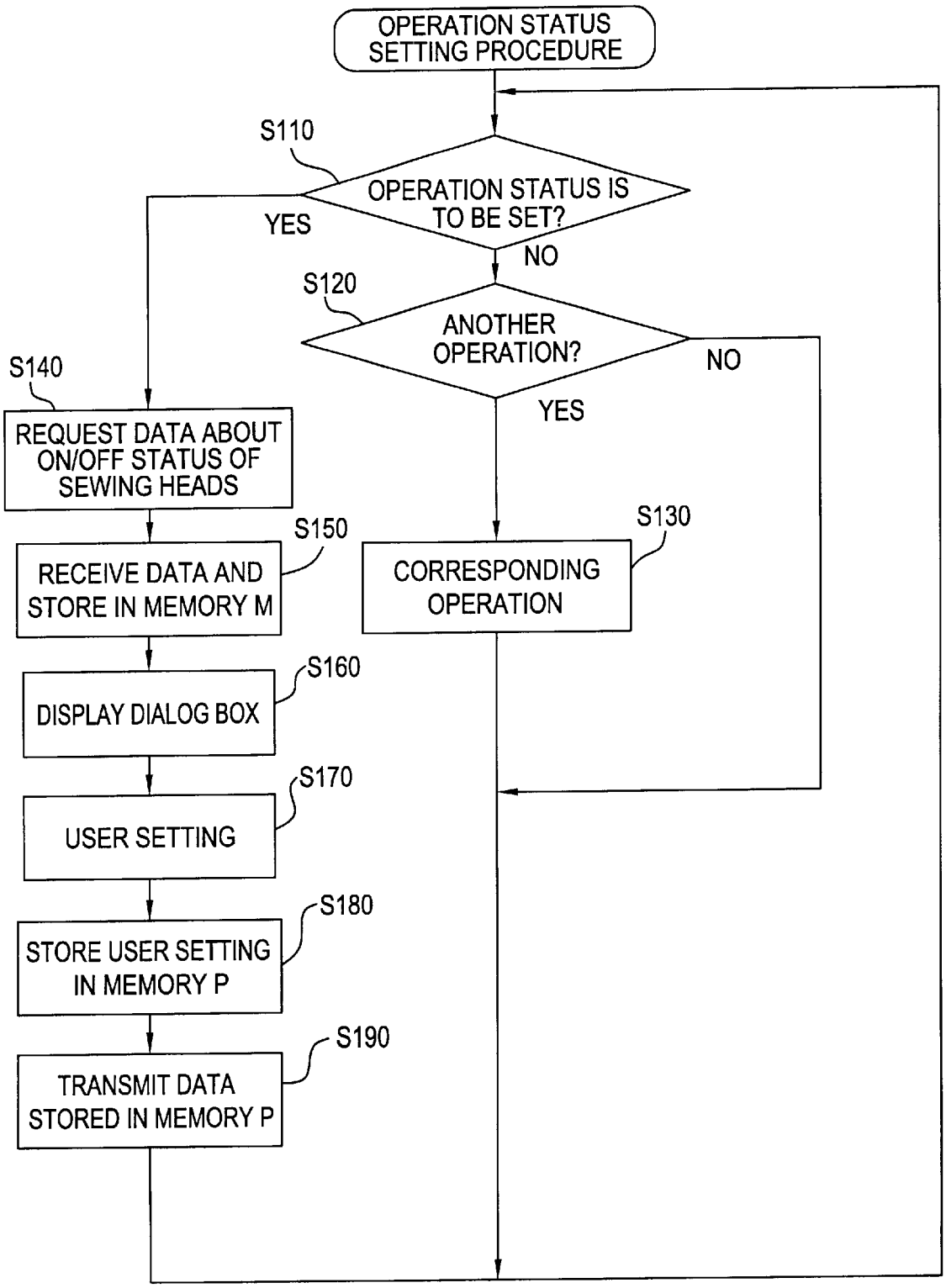
FIG. 3 shows a flowchart illustrating an operation status setting procedure executed by a personal computer.

If the personal computer 1 has issued the command requesting for the ON/OFF status of the stop switches 7*c* of the sewing heads at S140 of FIG. 3, the controlling device 7*d* receives the same (S240), and then transmits the data stored in the memory K to the personal computer 1 through the cable 2 (S310).

For example, if the data stored in the memories K and L are as shown in FIGS. 7A and 7B, respectively, the data stored in the memory K is copied into the memory M at S150. Thus, the dialog box 13*a* as shown FIG. 5A is displayed on the CRT display 13 of the personal computer 1.

When the operation status data representing the user-set operation status of the sewing heads 7*a,* which is stored in the memory P, has been transmitted from the personal computer 1 to the controlling device 7*d* at S190, the controlling device 7*d* receives the operation status data (S250:YES), and stores the received data in the memory L (S320).

For example, if the personal computer 1 transmits the data as shown in FIG. 5B, the data stored in the memories K and L becomes as shown in FIGS. 7C and 7D. Then, based on the data stored in the memory L, the actuators described above are driven (S230) to control the clutch mechanism. Thus, the ON/OFF status of the sewing heads 7*a* can be made coincident with the operation status set by the personal computer 1. In this example shown in FIG. 7D, the stop switches of the fourth and sixth heads 7*a* are set to "ON" to make the fourth and sixth heads 7*a* inoperative. After that, the data currently stored in the memory K is copied into the memory K' as shown in FIG. 7E.

If the second stop switch 7*c* of the sewing head 7*a* is manually set to "ON", and the sixth stop switch 7*c* is manually set to "OFF", the change of the ON/OFF status of the second and sixth switches 7*c* is detected at S280, and the data stored in the memory K is changed as shown in FIG. 7F. Since the data stored in the memory K has been changed with respect to the data stored in the memory K' (S230:YES), the data bits of the data stored in the memory L corresponding to the changed bits of the data stored in the memory K are changed accordingly (S290). In this example, the data stored in the memory K has been changed from the status shown in FIG. 7C to the status shown in FIG. 7F. That is, the second bit and the sixth bit of the data have been changed. Therefore, as shown in FIG. 7G, the second bit of the data stored in the memory L is set to "0", and the six bit is set to "1" (S290). In accordance with the data stored in the memory L, the actuator is driven (S30) to disconnect the clutch mechanism for the second and fourth sewing heads 7*a.* It should be noted that, in the above example, the fourth bit of the data stored in the memory L is not changed although the status of the stop switch 7*c* is OFF as shown in FIG. 7F, since the stop switch corresponding to the fourth bit has not been manually operated.

As above, it is possible to set the operation status of the sewing head 7*a* by either the stop switches 7*c* or the personal computer 1. Further, the setting operation performed by the personal computer 1 is done for all the sewing machines 3, 5, 7 and 9 through the keyboard 15 and/or the mouse 17 while monitoring the dialog box 13*a* displayed on the CRT display 13. Accordingly, with use of the system 100, the operator needs not to manually operate each stop switch individually, which enables an efficient setting of operation status and an efficient sewing operation.

Since the personal computer 1 receives the ON/OFF status data representing the ON/OFF status of the stop switches 3*c,* 5*c,* 7*c* and 9*c* detected by the controlling devices 3*d,* 5*d,* 7*d,* and 9*d,* respectively, and the ON/OFF status of the stop switches 3*c,* 5*c,* 7*c,* and 9*c* represented by the received data is displayed in the dialog box 13*a* as shown in FIG. 5A, the status of the stop switches 3*c,* 5*c,* 7*c* and 9*c* which were set manually can be recognized easily. What is to be done by the operator is to change the ON/OFF status of the stop switches whose settings are different from the intended ones. Thus, change of the setting of the stop switches can be done efficiently and correctly.

In the above-described embodiment, the personal computer 1 receives the status data representing the ON/OFF status of the stop switches, and displays the status of the stop switches on the CRT display. It may be possible to modify the above embodiment such that one of the controlling devices 3*d,* 5*d,* 7*d,* or 9*d* has a function similar to the personal computer 1 of the above-described embodiment, and that the procedure shown in FIG. 3 is executed by one of the controlling devices.

In the above-described embodiment, the data is transmitted between the personal computer 1 and the pattern sewing machines through the cable. The cable 2 can be replaced with some other means. For example, an infrared communication system can be used instead of the cable to transmit data.

The present disclosure relates to the subject matter contained in Japanese Patent Application No. HEI 09-73654, filed on Mar. 26, 1997, which is expressly incorporated herein by reference in its entirety.

What is claimed is:

1. A pattern sewing system, comprising:

at least one pattern sewing machine, each pattern sewing machine having a plurality of sewing heads;

an operation status setting device which is electrically connected to said at least one pattern sewing machine, said operation status setting device setting an operation status for sewing a specified pattern for each sewing head of said each pattern sewing machine such that said each swing head of said each specified pattern sewing machine is operative to sew the specified pattern or inoperative so as to not sew the specified pattern; and a controlling device for said each pattern sewing machine which makes said operation status set by said operation status setting device effective.

2. The pattern sewing system according to claim 1, wherein said operation status setting device comprises an independent device provided separately from said at least one pattern sewing machine.

3. The pattern sewing system according to claim 1, wherein said at least one pattern sewing machine comprises a plurality of pattern sewing machines each having a plurality of sewing heads, and wherein said controlling device is provided in each of said plurality of sewing machines.

4. The pattern sewing system according to claim 1, wherein said plurality of sewing heads comprise a plurality of manually operative switches respectively corresponding to said plurality of sewing heads, each of said plurality of manually operative switches setting operation status of said plurality of sewing heads such that each of said plurality of sewing heads is operative or inoperative, said operation status setting device utilizing said operation status set by said plurality of manually operative switches as initial status.

5. The pattern sewing system according to claim 4, wherein said operation status setting device sets said operation status of said plurality of said sewing heads by modifying said operation status set by said plurality of manually operative switches.

6. The pattern sewing system according to claim 5, wherein said operation status setting device comprises:

a display device which displays a dialog box showing said operation status of each of said plurality of manually operative switches; and a designating device which is manually operated to designate each of said operation status of said plurality of manually operative switches displayed in said display device, each of said operation status of plurality of manually operative switches being changed when designated by said designating device.

7. The pattern sewing system according to claim 6, wherein said designating device comprises a mouse.

8. The pattern sewing system according to claim 6, wherein said designating device includes a preventing device which prevents said operation status of each of said plurality of manually operative switches displayed on said display device from being designated to change said operation status of said plurality of sewing heads from inoperative to operative.

9. The pattern sewing system according to claim 4, wherein when said operation setting device sets said operation status of said plurality of sewing heads after said plurality of manually operative switches are operated, said operation status set by said operation setting device is made effective by said controlling device.

10. The pattern sewing system according to claim 9, wherein when at least one of said plurality of manually operative switches is operated after said operation setting device sets said operation status of said plurality of sewing heads, operation status of at least one of said plurality of sewing heads corresponding to said operated at least one of said plurality of manually operative switches is made effective by said controlling device.

11. An operation status setting device for setting operation status of each of a plurality of sewing heads of at least one pattern sewing machine, said operation status setting device being electrically connected to said at least one pattern sewing machine, said operation status setting device comprising:

a data receiving device which receives data representing a currently set operation status of each of said plurality of sewing heads from said at least one sewing machine;

a displaying device which displays said currently set operation status of each of said plurality of sewing heads based on data received by said data receiving device;

a manually operative member which is manually operated to change said currently set operation status of each of said plurality of sewing heads; and a data transmitting device which transmits, to said at least one sewing machine, data representing a currently set operation status in which operation of said manually operative member is reflected.

12. A method of changing operation status of a plurality of sewing heads in a sewing machine, each of said plurality of sewing heads being provided with a switch for setting operation status thereof to operative or inoperative, said method including the steps of:

receiving status data representing operation status of said plurality of sewing heads from a host controller;

storing said status data received from said host controller in a memory;

detecting a setting status of said switch for each of said plurality of sewing heads;

updating said status data stored in said memory with reference to said setting status of said switch; and driving said plurality of sewing heads in accordance with said status data stored in said memory and updated in said updating step.

13. A memory medium for storing a program executed by a controlling device which controls operation of each of a plurality of sewing heads of at least one pattern sewing machine, said controlling device being electrically connected to said at least one pattern sewing machine, said program comprising steps of:

receiving data representing a currently set operation status of each of said plurality of sewing heads from said at least one sewing machine;

displaying said currently set operation status of each of said plurality of sewing heads based on data received at the step of receiving;

changing said currently set operation status of each of said plurality of sewing heads; and transmitting, to said at least one sewing machine, data representing a currently set operation status in which changes made at the step of changing is reflected.

14. The pattern sewing system according to claim 4, wherein the operation status of a sewing head that has manually been set to inoperative by use of a manually operative switch cannot be reset to operative by the operation status setting device.

* * * * *

UNITED STATES PATENT AND TRADEMARK OFFICE

CERTIFICATE OF CORRECTION

PATENT NO. : 5,954,005

DATED : September 21, 1999

INVENTOR(S) : Kiyokazu Sekine, Kuwana-gun;
Fumiaki Asano, Nagoya, both of Japan

It is certified that error appears in the above-identified patent and that said Letters Patent is hereby corrected as shown below:

On the title page:

Please change "[73] Assignee: Brother kogyo Kabushiki Kaisha, Nagoya, Japan" to --[73] Assignee: Brother Kogyo Kabushiki Kaisha, Nagoya, Japan--

Please add --[30] Foreign Application Priority Data

Mar. 26, 1997 [JP] Japan.....9-073654--

Signed and Sealed this

Ninth Day of May, 2000

*Attest:*

Q. TODD DICKINSON

*Attesting Officer*

*Director of Patents and Trademarks*